US008844239B2

(12) United States Patent
Garot

(10) Patent No.: US 8,844,239 B2
(45) Date of Patent: Sep. 30, 2014

(54) ANCHORING ASSEMBLY AND FIXING DEVICE FOR SUCH AN ANCHORING ASSEMBLY

(76) Inventor: Wouter Garot, The Hague (NL)

( * ) Notice: Subject to any disclaimer, the term of this patent is extended or adjusted under 35 U.S.C. 154(b) by 0 days.

(21) Appl. No.: 13/471,909

(22) Filed: May 15, 2012

(65) Prior Publication Data

US 2012/0291393 A1 Nov. 22, 2012

(30) Foreign Application Priority Data

May 16, 2011 (NL) ..... 2006790

(51) Int. Cl.
*E04B 1/38* (2006.01)
*E04C 5/00* (2006.01)
*E04B 1/41* (2006.01)

(52) U.S. Cl.
CPC ..... *E04B 1/41* (2013.01); *E04B 1/4121* (2013.01); *E04B 2001/4192* (2013.01)
USPC ..... 52/699; 52/125.4; 52/687; 52/649.1; 52/704; 52/340; 52/745.21

(58) Field of Classification Search
USPC ..... 52/125.3, 125.4, 334, 698, 687, 677, 52/649.1, 699, 704, 709, 340, 23, 2.26, 52/146, 150
See application file for complete search history.

(56) References Cited

U.S. PATENT DOCUMENTS

| | | | | | |
|---|---|---|---|---|---|
| 2,520,998 | A * | 9/1950 | Cella | 217/19 |
| 2,724,165 | A * | 11/1955 | Williams | 249/207 |
| 3,657,851 | A * | 4/1972 | Chambers et al. | 52/378 |
| 4,835,933 | A * | 6/1989 | Yung | 52/685 |
| 5,358,423 | A * | 10/1994 | Burkhard et al. | 439/402 |
| 5,493,833 | A * | 2/1996 | Irimies | 52/336 |
| 6,058,672 | A | 5/2000 | McClellan | |
| 6,092,849 | A * | 7/2000 | Zambelli et al. | 294/89 |
| 7,065,925 | B2 * | 6/2006 | Hansort | 52/125.5 |
| 7,469,515 | B2 * | 12/2008 | Minor | 52/719 |
| 2007/0131658 | A1 * | 6/2007 | Champney et al. | 219/98 |
| 2008/0196324 | A1 * | 8/2008 | Mackay Sim | 52/125.4 |
| 2009/0205268 | A1 * | 8/2009 | Fletcher | 52/125.4 |

FOREIGN PATENT DOCUMENTS

| | | | |
|---|---|---|---|
| DE | 7606293 | U1 | 8/1977 |
| EP | 0039931 | A2 | 11/1981 |
| EP | 0832840 | A2 | 4/1998 |
| FR | 2054723 | A5 | 5/1971 |
| KR | 20030040322 | A | 5/2003 |
| KR | 100995121 | B1 | 11/2010 |

OTHER PUBLICATIONS

Translation of DE7606293 provided by European Patent Office on espacenet.*

(Continued)

*Primary Examiner* — Brian Glessner
*Assistant Examiner* — Brian D Mattei
(74) *Attorney, Agent, or Firm* — Shumaker, Loop & Kendrick, LLP

(57) ABSTRACT

An anchoring assembly for anchoring a liner of a cured lining material applied in liquid form to metal objects, comprising a fixing device welded or soldered to a metal object, the fixing device comprising a weld element and a fixing element provided with a through hole, and an anchoring element configured to be passed through the through hole of the fixing device, wherein the weld element comprises a weld or solder stud.

15 Claims, 5 Drawing Sheets

(56) References Cited

OTHER PUBLICATIONS

Translation of DE7606293 issued Aug. 1977 provided by European Patent Ofice on espacenet.*

International Search Report for NL 2006790 dated Nov. 8, 2011.
Database WPI, Week 201103, Thomas Scientific, London, GB; AN 2010-P97468, XP002663024.
Database WPI, Week 200360, Thomas Scientific, London, GB; AN 2003-633769, XP002663025.

* cited by examiner

ANCHORING ASSEMBLY AND FIXING DEVICE FOR SUCH AN ANCHORING ASSEMBLY

CROSS-REFERENCE TO RELATED APPLICATION

This application claims priority to Dutch patent application no. 2006790 filed May 16, 2011, the contents of which are incorporated by reference herein.

BRIEF SUMMARY OF THE INVENTION

According to a first aspect, the present invention relates to an anchoring assembly for anchoring a liner of a cured lining material applied in liquid form to metal objects, said anchoring assembly comprising a fixing device adapted to be welded or soldered to a metal object, which fixing device comprises a weld element and a fixing element provided with a through hole, and an anchoring element that can be passed through the through hole of the fixing device.

A known anchoring assembly comprises a rectangular plate provided with a through hole. The weld element is formed by a short end weld side remote from the through hole of the rectangular plate. The fixing device is formed by a portion of the rectangular plate around the through hole. The known anchoring element, when used, is welded to a metal object with its short end weld side, using electrodes. Then a bent rod-shaped anchoring element is passed through the through hole and fixed in a desired position. Once the anchoring assemblies required for adequate anchoring have been welded to the metal object and the anchoring elements have been fixed in position, pouring of the liner, for example cement, can take place.

A drawback of the known anchoring assembly is the fact that welding the rectangular plates to the metal object and subsequently fixing the anchoring element in a desired position is a time-consuming operation.

Accordingly it is an object of the present invention, according to the first aspect thereof, to provide an anchoring assembly as described in the introduction, which is easier to provide on a metal object in the desired position. This object is achieved by the present invention in that the weld element comprises a weld or solder stud designed for being welded or soldered, respectively, to a metal object by stud welding or soldering. Weld or solder studs are known to the skilled person in various embodiments thereof. The idea underlying the invention is that a weld or solder stud can be welded to a metal object in a simple and quick manner in use, for example in situ, by stud welding or soldering. It can thus be attached to a metal object in a much simpler manner than is possible with a known fixing device in the form of a rectangular plate, making it possible to realise a significant saving in time. Also, anchoring assemblies according to the invention are easier to handle, store and transport to a workplace than alternative anchoring assemblies of which the weld element is already pre-welded or soldered to an anchoring rail. The object of the present invention is thus accomplished.

German Gebrauchsmuster DE 7606293 U1 describes an anchor pre-welded to an anchoring rail for attaching construction elements to concrete (to be) poured in situ.

U.S. Pat. No. 6,058,672 describes a two-part anchor, wherein a connecting eye is connected to a sleeve provided with internal screw thread, which is to be attached to a second part of the anchor by means of a bolt.

French patent FR 2,054,723 likewise describes a concrete anchoring arrangement, in which a fixing device can be screwed onto a threaded pin. Said pin forms an integral part of a wall.

European patent application EP 0 039 931 describes an anchor type having a base portion configured as a plate, a bracket of which anchor is pre-welded to the base plate.

In a preferred embodiment of the present invention, the weld or solder stud has a substantially constant cross-section along the length thereof. Furthermore, the welding surface is preferably provided at the end of the weld element remote from the fixing element. The fixing element thus has a shape which is simple and easy to handle.

In a preferred embodiment of the present invention, aluminium is provided on the welding surface, thereby promoting the melting bath during the stud welding operation.

It is preferable in that regard if said aluminium is present in the welding or soldering surface of the weld or solder stud in the form of a ball. Such a no-loss position of the ball makes it easier to handle the weld or solder stud during the stud welding operation.

If the fixing element is at least substantially flat, with the through hole extending from a flat surface of the fixing element to an opposite flat surface of the fixing element, a fixing device that is easy to handle is provided.

In a preferred embodiment of the present invention, the fixing device forms an integral element. Thus, a fixing element can be simply attached to a metal object in one operation, viz. a stud welding operation.

Alternatively, the fixing device is an assembled or at least assemblable element. The various elements can thus be made of different materials, and standard elements can be assembled to form a desired fixing element.

It is preferable in that regard if the fixing device comprises a weld or solder stud and a fixing element connected or at least to be connected thereto. If, for example, the weld element or the fixing element comprises external screw thread, and the other of the aforesaid two elements comprises corresponding internal screw thread, the two elements can be connected together in a simple manner after stud welding or soldering of the weld or solder stud has taken place.

In a preferred embodiment of the present invention, the fixing element is made of stainless steel. This renders the fixing element suitable for applications in which corrosion can affect the quality of the anchoring assembly. For the same reason the weld or solder stud may be copper-plated.

In a preferred embodiment of the present invention, the anchoring assembly comprises a clamping element, by means of which the anchoring element is clamped to the fixing device in use. The anchoring element can thus be readily fixed in a desired position. It is preferable in that regard if the fixing device comprises a first engagement surface portion and the clamping element comprises a corresponding second engagement surface. The anchoring element can thus be clamped between the fixing device and the clamping element.

According to a second aspect, the present invention relates to a fixing device for use with an anchoring assembly according to the first aspect of the present invention. A fixing device according to the second aspect of the invention comprises a weld or solder stud designed to be welded or soldered to a metal object by stud welding or soldering, and a fixing element provided with a through hole which is or at least is to be connected thereto. The connection may be a permanent connection, for example such that the fixing device is an integral element.

According to a third aspect, the present invention relates to a method for fixing anchoring assemblies comprising a fixing device to a metal object, comprising the steps of: (1) providing the metal object and at least one fixing device of at least one anchoring assembly; (2) welding or soldering the at least one fixing device to the metal object; and (3) connecting an anchoring element to the at least one fixing device, wherein a fixing device comprising a weld or solder stud is provided in step (1), which weld or solder stud is welded or soldered to the metal object by stud welding or soldering in step (2).

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

The present invention will now be explained in more detail with reference to the appended drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
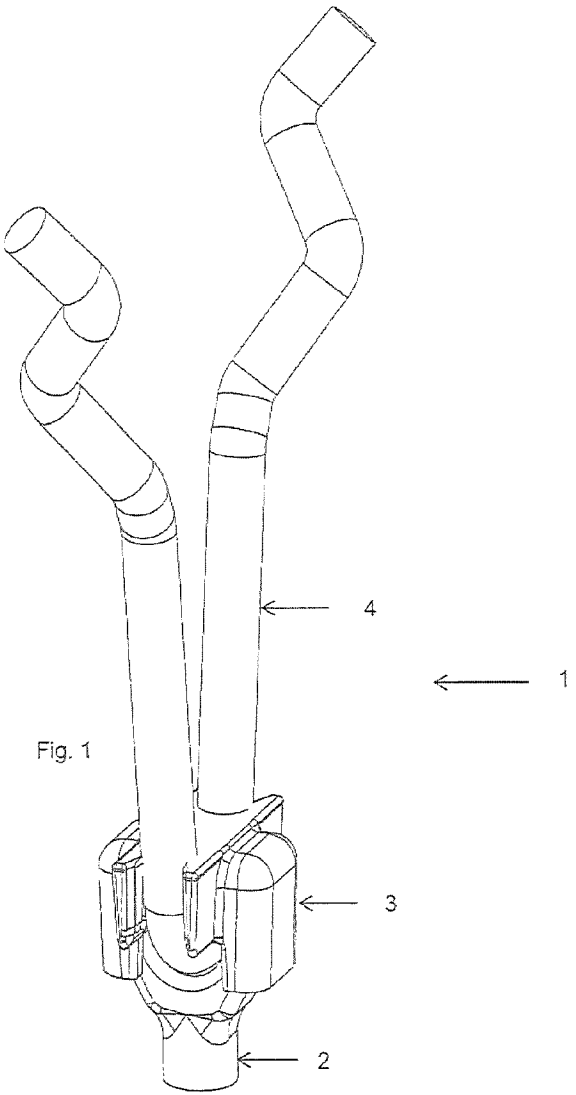
FIG. 1 is a perspective view of an exemplary embodiment of an anchoring assembly according to the present invention.

FIG. 1 shows a perspective side view of an anchoring assembly 1 according to the present invention. The anchoring assembly 1 comprises a fixing device 2, in which an anchoring element 4 is held by means of a clamping element.

Figure 2A:
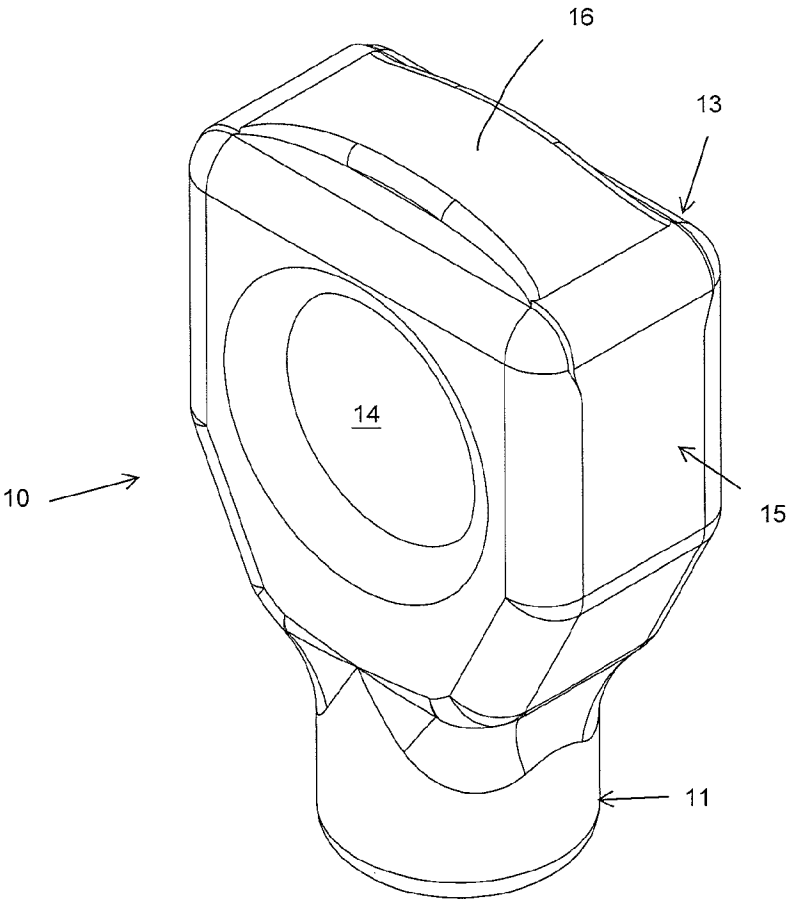
FIG. 2*a* is a perspective view of a fixing device according to the present invention.
Figure 2B:
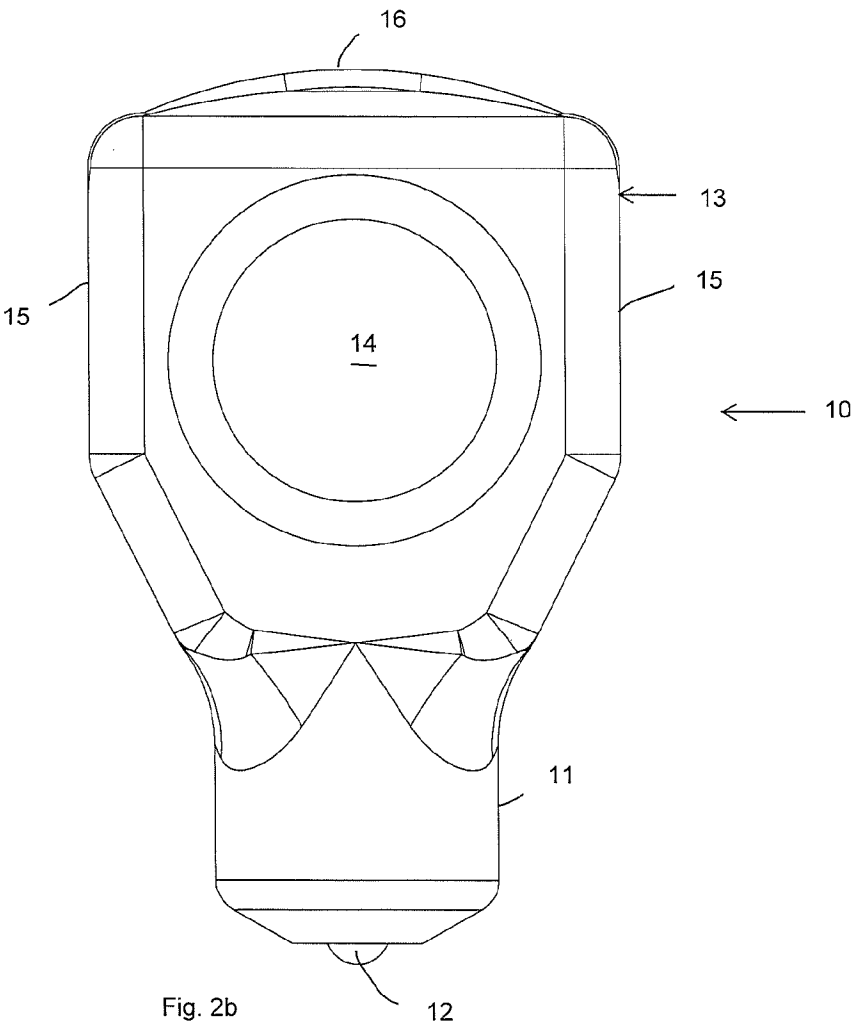
FIG. 2*b* is a front view of the fixing device of FIG. 2*a;*

FIGS. 2*a* and 2*b* show a perspective view and a side view, respectively, of a fixing device 10 according to the present invention. The fixing device 10 is an integral element, substantially made of stainless steel, and comprises a weld stud 11, an aluminium ball 12 and a fixing element 13 provided with a through hole 14. On both sides 15 and at the upper side 16 the fixing element 13 is configured so that the clamping element (not shown in FIGS. 2*a* and 2*b*), such as the clamping element 3 shown in FIG. 1, can be engagingly clamped on the fixing element 13 in a simple but firm manner. The specific configurations of the sides 15 and the upper side 16 are not relevant as such, as long as a correspondingly designed clamping element is available.

Figure 3A:
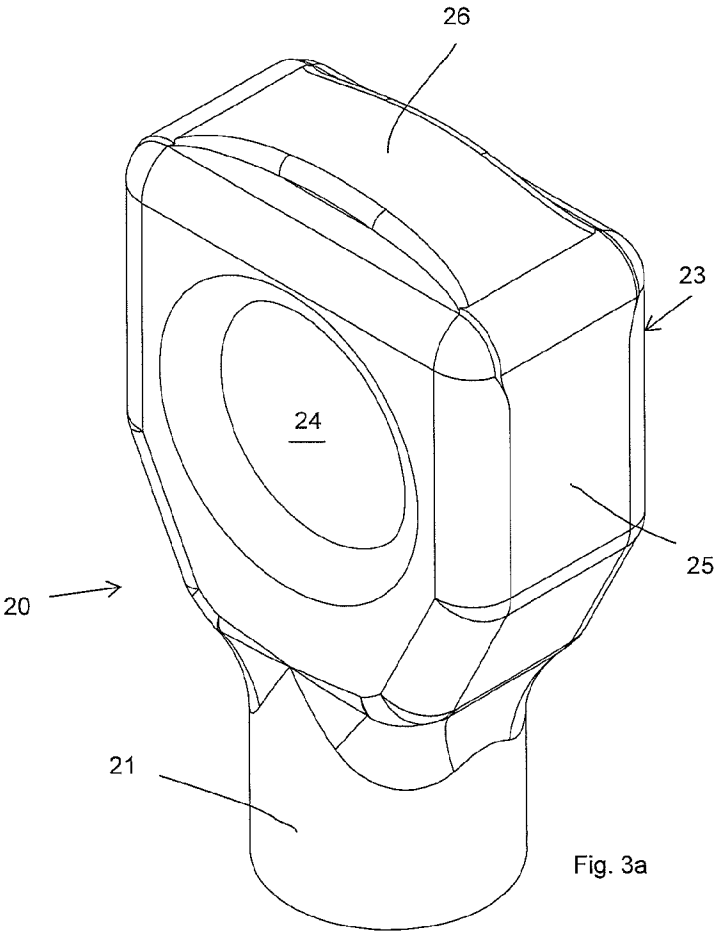
FIG. 3*a* is a perspective view of an alternative fixing element according to the present invention.
Figure 3B:
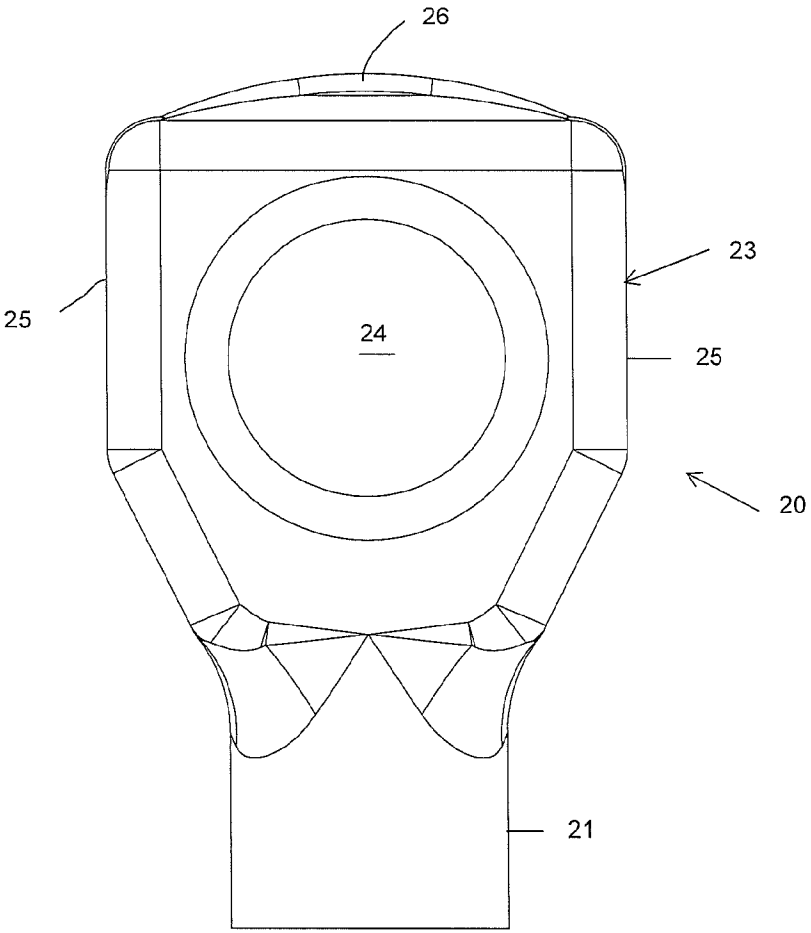
FIG. 3*b* is a front view of the fixing element of FIG. 3*a;*

FIGS. 3*a*, 3*b* show a perspective view and a front view, respectively, of an alternative embodiment of a fixing device 20 according to the present invention. The fixing device 20 is substantially made of stainless steel and comprises a sleeve 21 provided with internal screw thread (not shown) and a fixing element 23 provided with a through hole 24, sides 25 and an upper side 26, comparable to the fixing element 13 of FIG. 2. The fixing device 20 can be fixed as such to a weld stud (not shown in FIGS. 3*a*, 3*b*, but forming part of the fixing device) provided with external screw thread, as will be explained in more detail yet with reference to FIG. 6.

Figure 4:
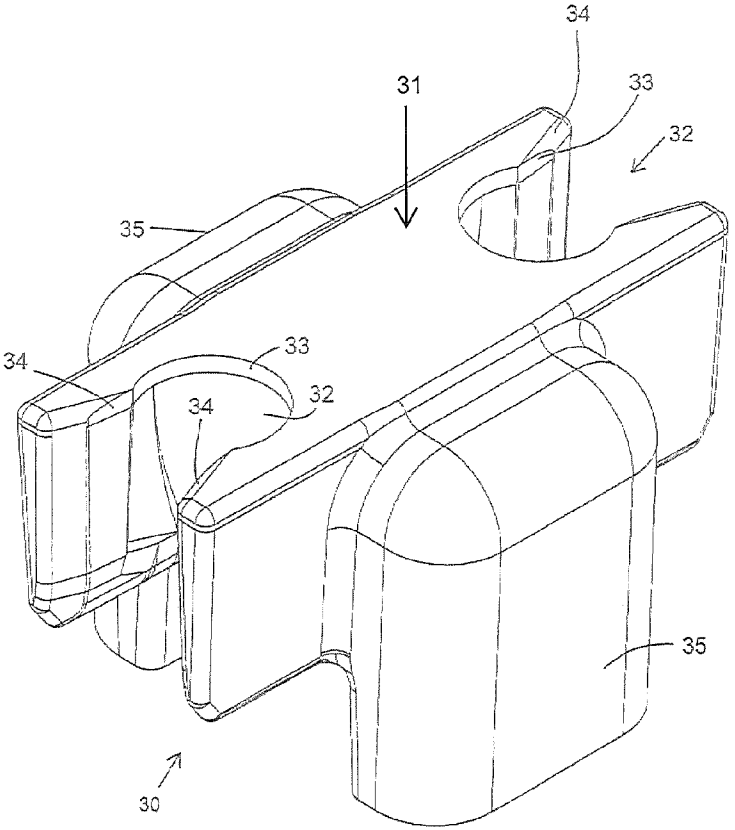
FIG. 4 is a perspective view of a clamping element of the anchoring assembly of FIG. 1.

FIG. 4 is a perspective top plan view of a clamping element 30 comparable to the clamping element 3 of FIG. 1. The clamping element 30 may be made of plastic material or of a(n) (at least slightly) elastic metal. The clamping element 30 comprises a beam-shaped central element 31, which is provided with keyhole-shaped recesses 31 at the short ends thereof. Arms of an anchoring member (not shown in FIG. 4) having a circular cross-section can be accommodated in the circular part 33 of the keyhole-shaped recesses 32. The arms (not shown) can be guided to the circular parts 33 via guide surfaces 34 of the keyhole-shaped recesses 32. The keyhole-shaped recess 32 is narrowed at the location of the transition between the guide surfaces 34 and the circular parts 33 of the recesses. When the clamping element 30 is placed, partially surrounding an anchoring element, the guide surfaces 34 are pushed apart by the arms of the anchoring element. After passing the guide surfaces, an arm of an anchoring element is clamped down in the circular recess 33 in that the guide surfaces will eventually resiliently return to their original position. A comparable situation is shown in FIG. 1. Two wings 35 on either side of the beam-shaped central element 31 are placed and clamped around the sides (comparable to the sides 25, 35 of the fixing devices 10 and 20, respectively) in use.

Figure 5:
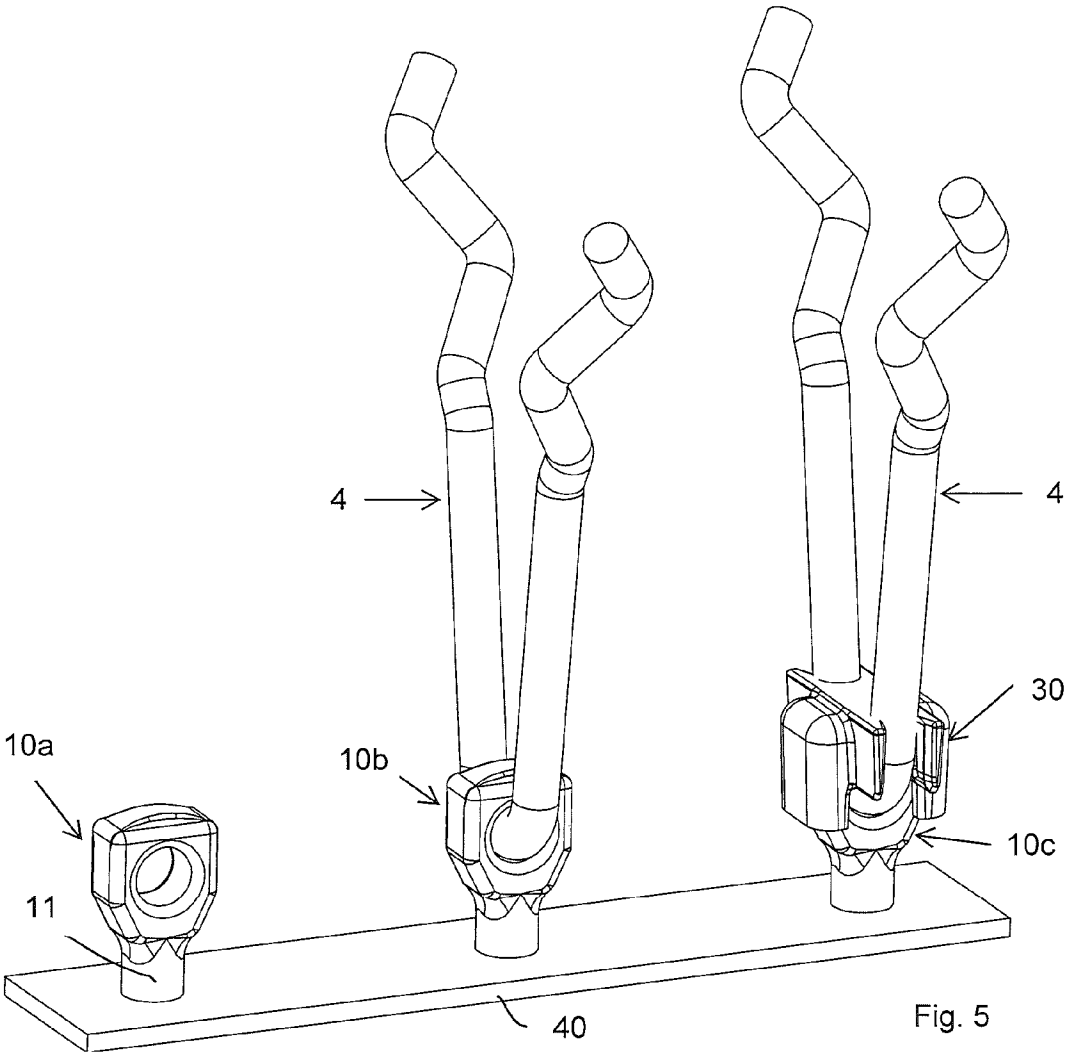
FIG. 5 is a perspective view of a metal object with anchoring assemblies according to the present invention during various stages of assembly.

FIG. 5 shows a part of a metal object 40 with anchoring elements according to the present invention provided on the metal object 40 during various stages of attachment. The metal object 40 may be a stainless steel wall, against which cement must be poured and allowed to cure. On the left-hand side of the metal object 40, a fixing device 10 provided with a weld stud 11 is stud-welded to the metal object 40. The second fixing device 10*b* has an anchoring element 4 inserted into the through hole 14 thereof. The fixing device 10*c* has an anchoring element 4 clamped thereon by means of the clamping element 30. Once sufficient anchoring assemblies 1 are provided in the fully assembled condition as shown for the fixing device 10*c*, cement can be poured on the metal object 40.

Figure 6:
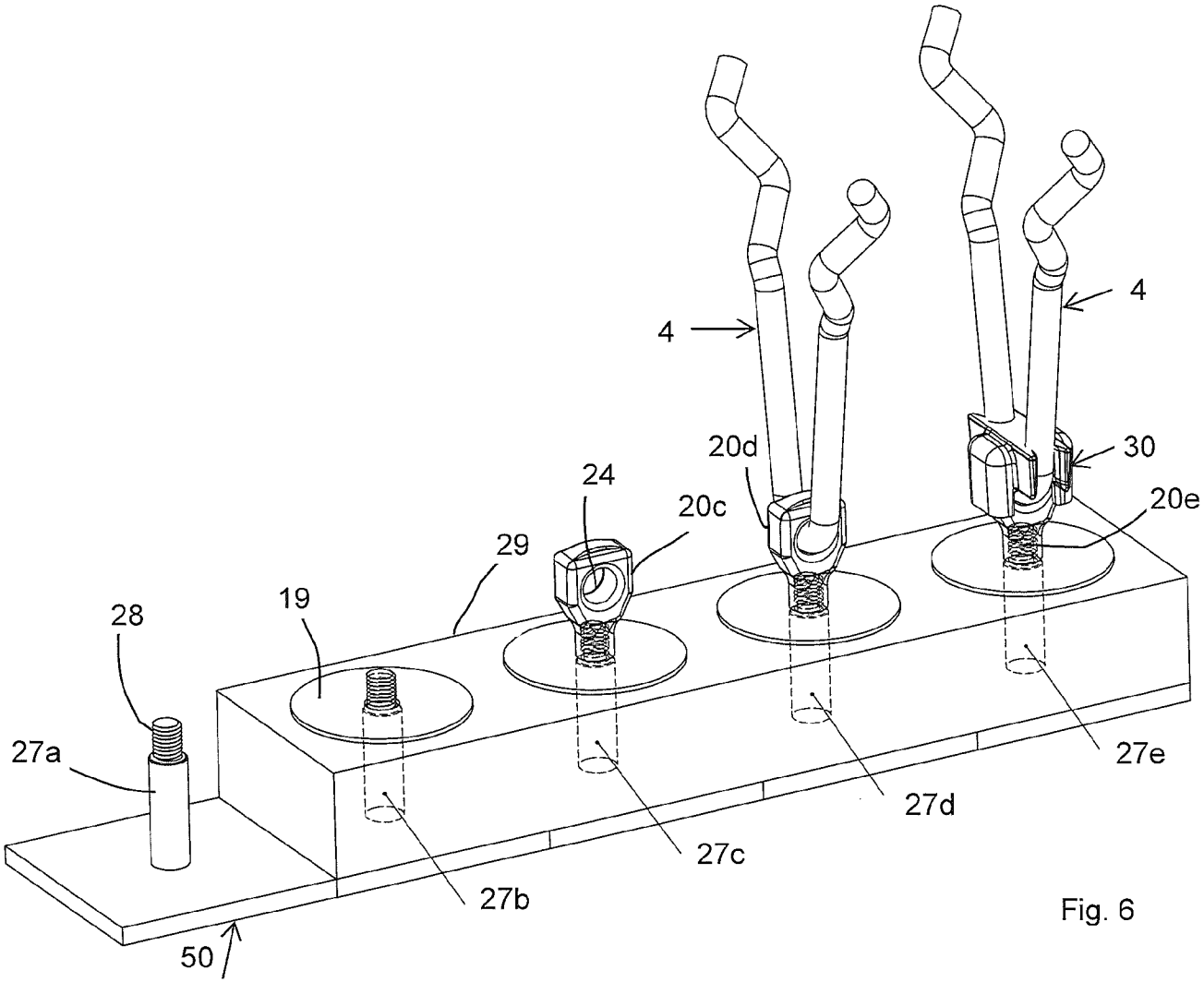
FIG. 6 is a perspective view of a metal object with an alternative anchoring assembly during various stages of assembly.

FIG. 6, to conclude, shows a part of a metal object 50 with anchoring assemblies provided with a fixing device 20 provided thereon during various stages of assembly. On the left-hand side of FIG. 6, a weld stud 27*a* provided with external screw thread 28 is welded to the metal object 50. Furthermore, an insulation block 29 is placed over the weld studs 22 in such a manner that the screw thread 28 is clear at all times. A ring 19 is placed over the external screw thread 28*b* of the weld stud 27*b*. A fixing device 20*c* provided with internal screw thread is placed over external screw thread of the weld stud 27*c*. An anchoring element 4 is inserted into the through hole 24 of the fixing device 20*d*. A clamping element 30 is placed over the anchoring element 4 and the fixing device 20*e*.

Only a few embodiments of anchoring assemblies and fixing devices according to the invention are shown and described in the appended drawings and above description. It will be understood, however, that many variants, which may or may not be obvious to those skilled in the art, are conceivable within the scope of the invention, which is defined in the appended claims. Thus, various suitable materials may be used for the various elements. The weld stud may be a solder stud, which is soldered to the metal object in that case. The term "weld stud" or "solder stud" as used herein is understood to mean a pin-shaped element suitable for being welded or soldered to a metal object with its short end surface. The separation between a weld stud and the fixing device may be provided at a different position, using different fixing means, than the position and the fixing means shown and described herein. Various forms of anchoring elements can be used, of course, depending on the use and/or the user's requirements. The various elements may furthermore be connected together in various ways.

What is claimed is:

1. An anchoring assembly, comprising:

a fixing device including a tapered end adapted to be welded or soldered to a metal object, and a through hole spaced from the, and having a through hole axis an anchoring element received through the through hole of the fixing device, the anchoring element including two arms each terminating in a plurality of interconnected segments oriented in different directions; and a clamping element configured to cap the end of the fixing device opposite the tapered end and defining two recesses for capturing the two arms of the anchoring element to prevent relative movement between the fixing device and the anchoring element; and wherein the two recesses are arranged at an angle to one another such that the two arms diverge exiting the clamping element, and wherein the two recesses are arranged at an inclined angle to the through hole axis.

2. The anchoring assembly according to claim 1, wherein the weld or solder stud has a substantially constant cross-section along a length thereof.

3. The anchoring assembly according to claim 1, wherein the welding surface is provided at the end of the weld element remote from the fixing element.

4. The anchoring assembly according to claim 3, wherein aluminum is provided on the welding surface.

5. The anchoring assembly according to claim 1, further comprising an aluminum ball protruding from the tapered end of the fixing device.

6. The anchoring assembly according to claim 1, wherein the fixing element is at least substantially flat, and wherein the through hole extends from a flat surface of the fixing element to an opposite flat surface of the fixing element.

7. The anchoring assembly according to claim 1, wherein the fixing device forms an integral element.

8. The anchoring assembly according to claim 1, wherein each of the two arms includes an elongate linear portion extending between the fixing device and the plurality of interconnected segments.

9. The anchoring assembly according to claim 1, wherein the clamping element comprises two recesses having angled end portions connected to circular parts for guiding the two arms into the respective recess and clamping around the two arms of the anchoring element.

10. The anchoring assembly according to claim 9, wherein the fixing device comprises a first engagement surface portion and the clamping element comprises a corresponding second engagement surface.

11. A fixing device for use with the anchoring assembly according to claim 1, the fixing device comprising a weld or solder stud designed to be welded or soldered to a metal object by stud welding or soldering, and the fixing element provided with the through hole which is or at least is to be connected thereto.

12. The anchoring assembly according to claim 1, wherein the through hole is substantially axially perpendicular to each of the two recesses.

13. A method for fixing anchoring assemblies including a fixing device to a metal object, comprising the steps of:

(1) providing a metal object and at least one fixing device of at least one anchoring assembly;

(2) welding or soldering the at least one fixing device to the metal object;

(3) connecting an anchoring element to the at least one fixing device;

the at least one fixing device including a weld or solder stud having a tapered end surface, and the anchoring element including two arms each terminating in a plurality of interconnected segments oriented in different directions; and (4) fixing the anchoring element with respect to the at least one fixing device by way of a clamping element, the clamping element capping, the end of the fixing device opposite the tapered end and defining two recesses for capturing the two arms of the anchoring element to prevent relative movement between the fixing device and the anchoring element; and wherein the anchoring element is received through a through hole of the fixing device, the through hole having a through hole axis, and wherein the two recesses are arranged at an angle to one another such that the two arms diverge exiting the clamping element, and wherein the two recesses are arranged at an inclined angle to the through hole axis.

14. The method according to claim 13, wherein the weld or solder stud further comprises an aluminum ball protruding from the end surface.

15. The method according to claim 13, wherein the through hole is substantially axially perpendicular to each of the two recesses.

* * * * *

UNITED STATES PATENT AND TRADEMARK OFFICE

CERTIFICATE OF CORRECTION

PATENT NO. : 8,844,239 B2
APPLICATION NO. : 13/471909
DATED : September 30, 2014
INVENTOR(S) : Wouter Garot It is certified that error appears in the above-identified patent and that said Letters Patent is hereby corrected as shown below:

In the claims:

Column 5, line 27, delete "the, and having a through hole axis" insert --the tapered end, and having a through hole axis;--

Signed and Sealed this
Twenty-fourth Day of March, 2015

Michelle K. Lee

Michelle K. Lee
*Director of the United States Patent and Trademark Office*